US007380524B2

(12) United States Patent
Hand

(10) Patent No.: US 7,380,524 B2
(45) Date of Patent: Jun. 3, 2008

(54) WATER HEATER CHAMBER WRAP

(75) Inventor: James R. Hand, Fairview, TN (US)

(73) Assignee: Owens Corning Intellectual Capital, LLCDE (US)

( * ) Notice: Subject to any disclaimer, the term of this patent is extended or adjusted under 35 U.S.C. 154(b) by 209 days.

(21) Appl. No.: 10/609,929

(22) Filed: Jun. 30, 2003

(65) Prior Publication Data

US 2004/0261728 A1 Dec. 30, 2004

(51) Int. Cl.
*F24H 9/02* (2006.01)

(52) U.S. Cl. ..... 122/19.2; 122/494; 220/694.1

(58) Field of Classification Search ..... 122/19.2, 122/494, 13.01; 220/567.3, 495.01, 694.1, 220/592.11, 592.1, 592.21
See application file for complete search history.

(56) References Cited

U.S. PATENT DOCUMENTS 1,609,858 A * 12/1926 Bohon ..... 126/361.1
1,827,521 A * 10/1931 Heathman ..... 122/17.1
4,039,098 A * 8/1977 Stilts ..... 220/694.1
4,372,028 A * 2/1983 Clark et al. ..... 29/460
4,447,377 A 5/1984 Denton
4,447,484 A * 5/1984 Slosberg et al. ..... 428/137
4,527,543 A 7/1985 Denton
4,744,488 A * 5/1988 Nelson ..... 220/567.3
4,749,532 A 6/1988 Pfeffer
4,860,728 A 8/1989 Nelson
4,875,272 A 10/1989 Nelson
4,945,892 A 8/1990 Chevalier et al.
4,956,909 A 9/1990 Nelson
4,998,970 A * 3/1991 Nelson ..... 122/19.2
5,020,481 A 6/1991 Nelson
5,024,210 A 6/1991 Nelson
5,052,347 A 10/1991 Nelson
5,163,214 A 11/1992 Calero
5,246,759 A * 9/1993 Keller ..... 428/74
5,263,469 A * 11/1993 Hickman ..... 126/344
5,274,196 A * 12/1993 Weinberg ..... 174/121 R
RE34,534 E 2/1994 Staats
5,678,533 A 10/1997 Liljegren
5,711,256 A * 1/1998 Brandon ..... 122/19.2
5,797,355 A 8/1998 Bourke et al.
5,921,230 A 7/1999 Vessells et al.
6,029,615 A * 2/2000 Terwilliger et al. ..... 122/494
6,479,140 B1 * 11/2002 Takao et al. ..... 428/317.9
6,497,200 B2 * 12/2002 Stretch et al. ..... 122/504
6,499,439 B1 * 12/2002 Kohler et al. ..... 122/19.2
6,634,390 B2 * 10/2003 Toth ..... 138/146
6,670,291 B1 * 12/2003 Tompkins et al. ..... 442/136
2007/0113800 A1 * 5/2007 Foster et al. ..... 122/19.2

* cited by examiner

*Primary Examiner*—Gregory A. Wilson
(74) *Attorney, Agent, or Firm*—Inger H. Eckert; James J. Dottavio

(57) ABSTRACT

The present invention relates generally to an insulation wrap for a water heater tank including a strip of nonflammable fibrous material having an opening therein and a fibrous material element outlining at least a portion of that opening. In addition the present invention relates to a hot water heater incorporating the insulation wrap.

28 Claims, 4 Drawing Sheets

WATER HEATER CHAMBER WRAP

TECHNICAL FIELD AND INDUSTRIAL APPLICABILITY OF THE INVENTION

The present invention relates generally to thermally insulated tank assemblies and, more particularly, to an improved insulation wrap for a water heater tank as well as a water heater incorporating such a wrap.

BACKGROUND OF THE INVENTION

Insulated tank assemblies such as water heaters have long been known in the art. Such structures typically comprise an inner storage tank or vessel and an outer shell or jacket. Typically, both the inner storage tank and outer jacket are cylindrical in shape. Typically the jacket is coaxial with and radially spaced from the tank so that an annular space or void is formed therebetween. A polymer foam insulating material is commonly provided in at least a portion of this annular space to provide thermal insulation for the liquid held in the storage tank.

A particularly effective insulating material for this purpose is a polymer foam that is expanded directly in the annular space between the inner tank and jacket. Various types of epoxy and polyolefin foams have been utilized for this purpose and polyurethane foam has been found to be particularly effective.

More specifically, a polymer reactive composition is injected into the void or space between the tank and jacket and the resulting foam expands to fill the available space. The polymer foam is initially fluid and sticky. It, however, slowly expands to fill substantially all the space between the tank and jacket. As the polymerization reaction reaches its completion the polymer foam becomes stiff and stabilizes into a rigid, closed cell foam that fills the annular space surrounding the tank and forms a thermal insulation for the liquid held in the tank. The amount of liquid polymer reactant composition injected into the annular space is only sufficient to ensure that the annular space is filled with polymer foam without creating excessive over-pressure in the space.

Of course, water heater tanks incorporate a number of inlet, outlet and drain fittings. Further, a gas water heater includes a heating chamber at the bottom of the tank. Specifically, a gas burner is positioned in the heating chamber and water in the tank is heated with a flame from the burner. The tank also includes sensors for thermostatic control so that the water in the tank is maintained at a desired temperature. Many polymer foams used for insulation purposes are flammable and, accordingly, they must be maintained a safe distance from the open burner flame of the heating chamber.

Toward this end, it is presently common practice to provide a foam dam device in place in the annular space between the inner tank and outer jacket at a selected position along the height of the water heater. More specifically, the foam dam is compressed between the outer wall of the inner tank and the inner wall of the outer jacket so as to seal the space therebetween. Accordingly, the inner tank, the foam dam and the upper wall and side wall of the outer jacket form a sealed space that may be filled with the insulating polymer foam. The compressive sealing engagement of the dam between the tank and the jacket prevents the polymer foam from entering the lower portion of the annular space which includes the heating chamber and burner.

The present invention relates to a wrap for insulating the water heater tank below the foam dam and adjacent the heating chamber. The wrap not only functions to insulate the water heater tank but also controls airflow in the heating chamber by preventing undesired drafts from around the burner access door provided in the outer jacket.

SUMMARY OF THE INVENTION

In accordance with the purposes of the present invention as described herein, an improved insulation wrap for a water heater tank is provided. The insulation wrap includes a strip of nonflammable fibrous material including an opening and a fibrous material element outlining at least a portion of that opening. The insulation wrap may further include a foil layer on the strip of nonflammable fibrous material. A scrim may be included on that foil layer. That scrim may be of fiberglass.

An adhesive may be provided to secure the fibrous material element to the strip of nonflammable fibrous material. The strip of nonflammable fibrous material may be fiberglass. The fibrous material element may be constructed from a material selected from a group consisting of polyester, polyethylene, polypropylene, polyethylene terephthalate, glass fibers, natural fibers and any mixtures thereof. Stated another way, the fibrous material element may be constructed from a material selected from a group consisting of (a) thermoplastic polymer staple fibers and thermoplastic bicomponent fibers, (b) glass staple fibers and thermoplastic bicomponent fibers and (c) a combination of (a) and (b).

The fibrous material element of the insulation wrap may have a density of about 0.75 lbs/ft$^3$. In accordance with yet another aspect of the present invention a fastener may be provided for securing a first end and a second end of the strip of nonflammable fibrous material together. Such a fastener may take the form of a tape having an adhesive backing or cooperating male and female connectors.

In accordance with yet another aspect of the present invention a water heater is provided. The water heater includes an inner tank having a water inlet and a water outlet and an outer jacket received around the inner tank. A heating chamber is provided adjacent the inner tank in the outer jacket. A removable access door is provided in the outer jacket to allow access to the heating chamber. In addition the water heater includes an insulation wrap. That insulation wraps includes (a) a strip of nonflammable fibrous material wrapped around the inner tank and having an opening therein aligned with the access door, and (b) a fibrous material element outlining the opening of the access door.

The fibrous material element is constructed from a material selected from a group consisting of (a) thermoplastic polymer staple fibers and thermoplastic bicomponent fibers, (b) glass staple fibers and thermoplastic bicomponent fibers and (c) a combination of (a) and (b). Further, the fibrous material element may be constructed from a material selected from a group consisting of polyester, polyethylene, polypropylene, polyethylene terephthalate, glass fibers, natural fibers and any mixtures thereof.

In the following description there is shown and described preferred embodiments of the invention, simply by way of illustration of several of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain certain principles of the invention. In the drawings.

Reference will now be made in detail to the present preferred embodiments of the present invention, examples of which are illustrated in the accompanying drawings.

DETAILED DESCRIPTION OF THE INVENTION

Figure 1:
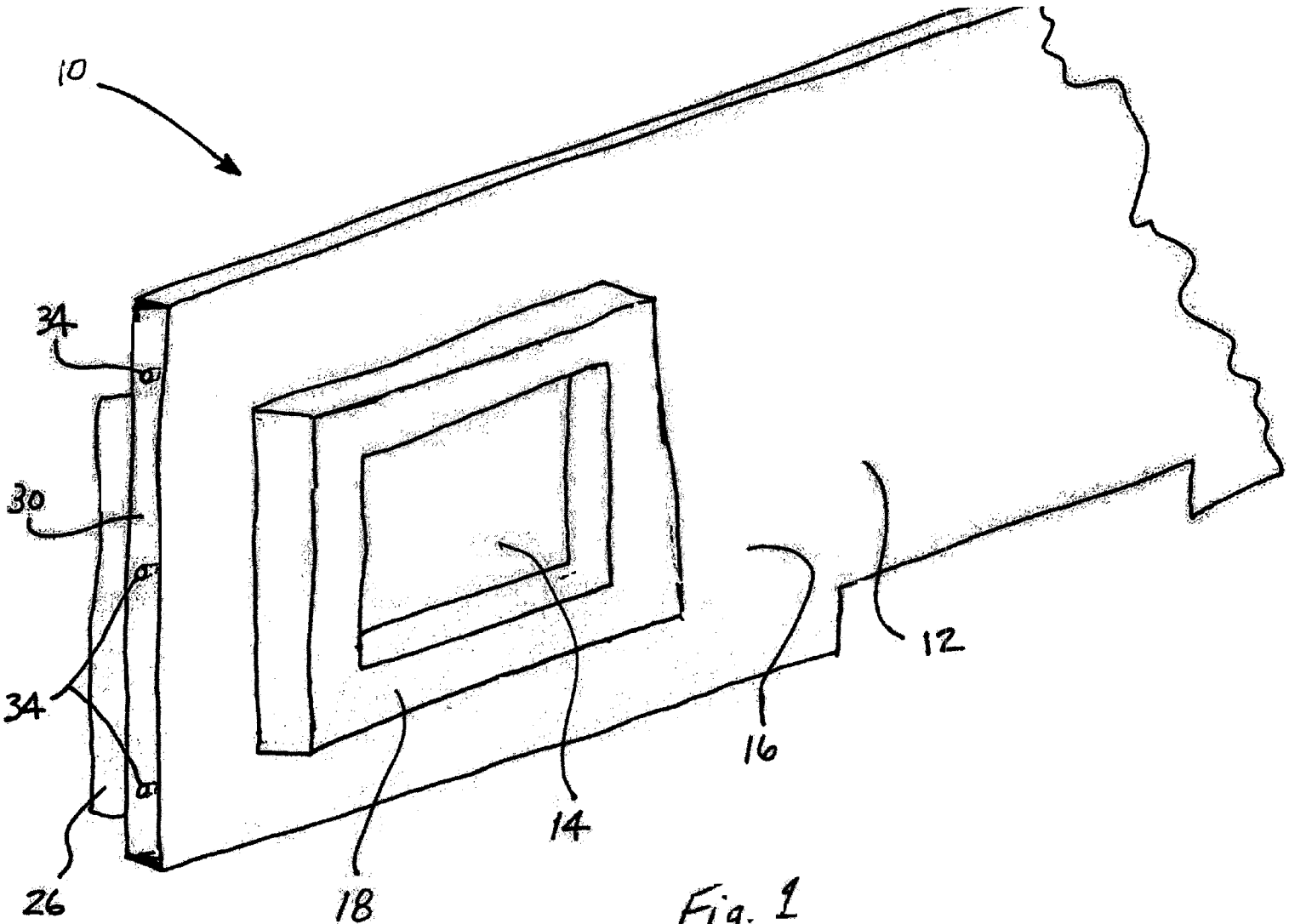
FIG. 1 is a perspective view of the insulation wrap of the present invention.
Figure 2:
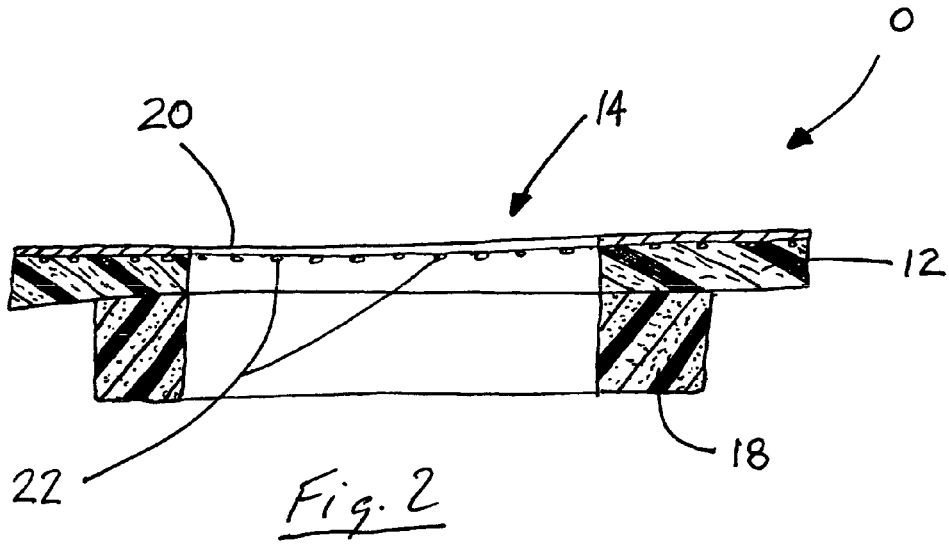
FIG. 2 is a cross section of the wrap shown in FIG. 1.
Figure 3A:
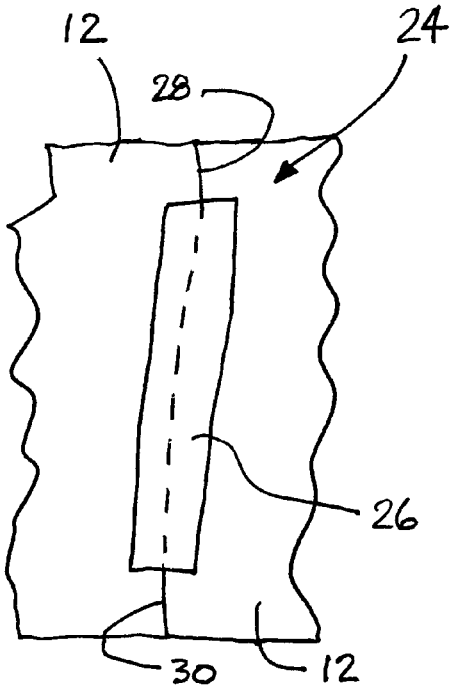
FIG. 3*a* is a detailed side elevational view illustrating the connecting together of the two ends of the wrap illustrated in FIG. 1 by means of an adhesive tape.
Figure 4:
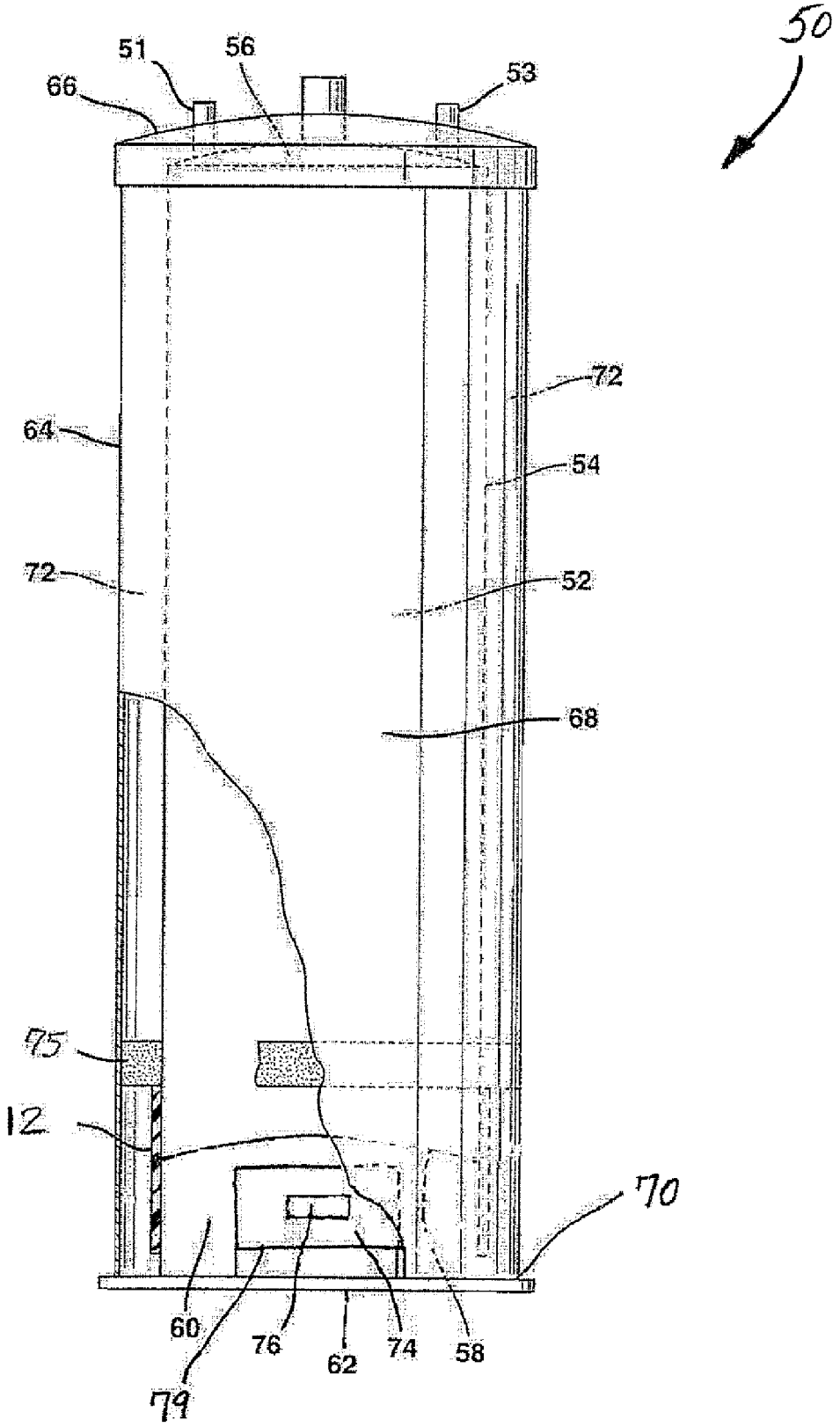
FIG. 4 is a schematical representation of a water heater in elevation with a partial cutaway section to show how the wrap illustrated in FIG. 1 of the present invention is applied and positioned in the water heater.
Figure 5:
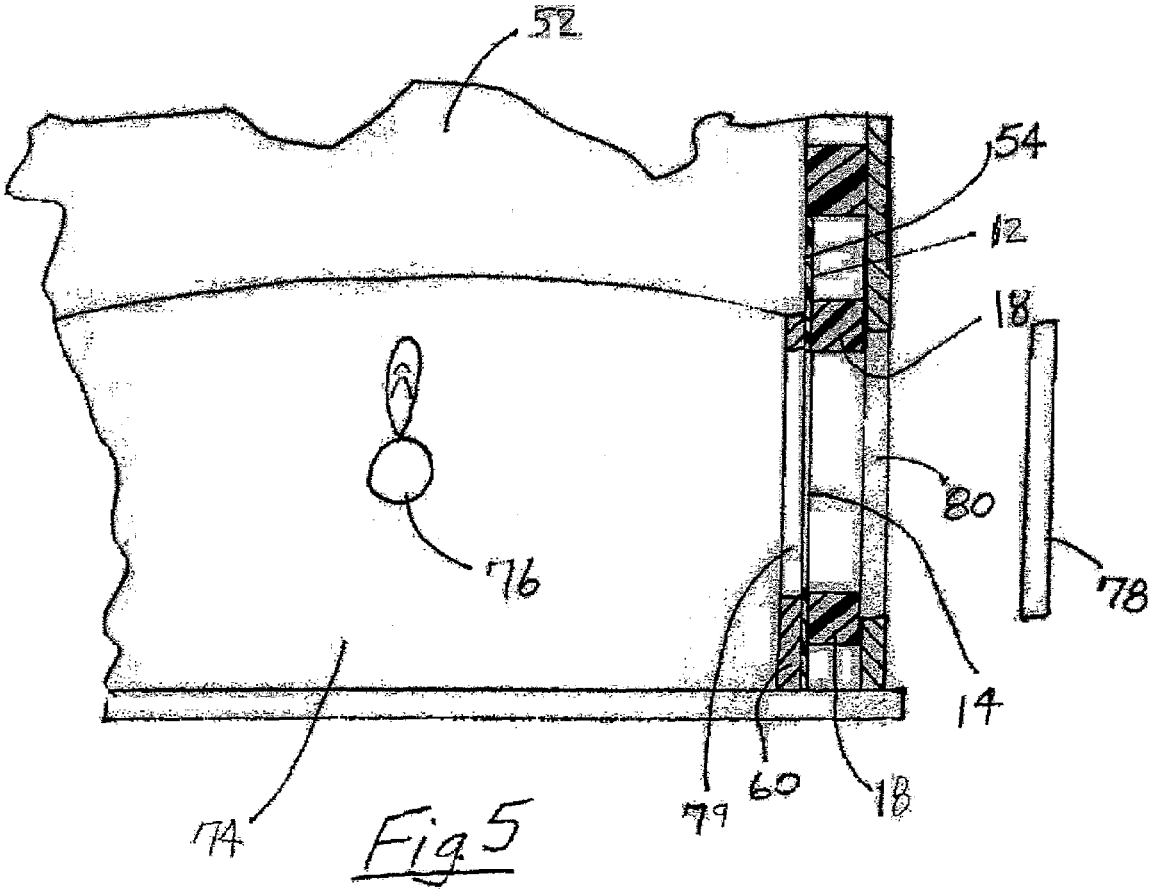
FIG. 5 is a schematical and cross-sectional view illustrating the relationship of the opening in the wrap relative to the access opening in the outer jacket and the heating chamber.

Reference is now made to FIGS. 1, 2 and 3*a* showing a first embodiment of the insulation wrap 10 of the present invention. As should be appreciated, such an insulation wrap 10 is particularly useful to insulate a water heater tank of a hot water heater as illustrated in FIGS. 4 and 5.

As illustrated, the insulation wrap 10 comprises a strip 12 of nonflammable fibrous material such as fiberglass. An opening 14 is provided in a face 16 of the strip 12. A fibrous material element 18 outlines at least a portion of the opening 14. For most applications, the wrap 10, including both the strip 12 and the element 18, fully outlines or encompasses the opening 14.

The fibrous material element 18 is constructed from a material selected from a group consisting of (a) thermoplastic polymer staple fibers and thermoplastic bicomponent fibers, (b) glass staple fibers and thermoplastic bicomponent fibers and (c) a combination of (a) and (b). More specifically, the fibrous material element 18 is constructed from a material selected from a group consisting of polyester, polyethylene, polypropylene, polyethylene terephthalate, glass fibers, natural fibers and any mixtures thereof. The glass fibers may include E-glass, S-glass or basalt fibers. Natural fibers such as hemp or kenaf may also be included. As a specific example, the fibrous material element 18 may be die cut from a 100% polyester fibrous material having a density as low as 1.5 pounds per cubic foot, such as Versamat 800 WHB material as manufactured by Owens Corning OEM Solutions Group of Louisville, Ky.

The fibrous material element 18 may have a density of about 0.75 lbs/ft$^3$. It may include an integral skin or surface layer of higher density in order to provide some additional rigidity to allow easier handling during installation and also provide a smooth face particularly suited for adhering with an adhesive (such as solid base contact glue, high temperature glue or water based spray adhesive) to the margin of the strip 12 outlining the opening 14.

The fiberglass comprising the strip 12 is needled so as to form a consolidated mat or blanket. Thus, the strip 12 possesses not only insulation properties but is also heat and flame resistant. Accordingly, the strip 12 is particularly suited for insulating the inner tank of a water heater in and around the area of the heating chamber and burner as will be described with reference to FIGS. 4 and 5 in greater detail below.

While not necessary, for many applications it will also be desired to provide a layer 20 of metallic foil on the strip 12 (see FIG. 2). More specifically, the layer 20 of metallic foil may be reinforced by a scrim 22 of, for example, fiberglass or other appropriate reinforcement material. Such a layer 20 provides additional insulating properties and reflects heat from the burner and the water tank back toward the tank. The foil layer 20 also helps prevent the fiberglass fibers from getting in the burner.

As illustrated in FIG. 3*a*, each strip 12 may include a fastener 24 illustrated as an adhesive backed metallic foil tape 26. Thus, the insulation wrap 10 may be formed into a ring with two abutting ends 28, 30 that are positively secured or locked together by the tape 26.

Figure 3B:
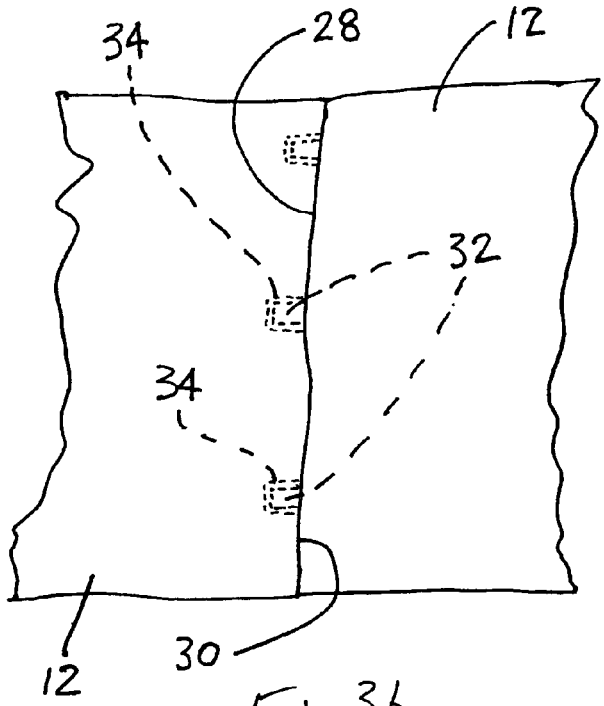
FIG. 3*b* is a detailed side elevational view illustrating the connecting together of the two ends of the wrap shown in FIG. 1 by means of cooperating male and female connectors.

In an alternative embodiment shown in FIG. 3*b*, the strip 12 includes interlocking structures in the form of multiple projecting lugs 32 at a first end 28 and cooperating multiple apertures or sockets 34 sized and shaped to receive the lugs on the second, opposite end 30. As illustrated in FIG. 3*b*, the lugs 32 are fully received and fit snugly in the apertures or sockets 34 allowing the ends 28, 30 of the strip 12 to abut one another when the ends are joined to form the insulation wrap 10 into a ring. Of course, it should be appreciated that the interlocking structure (i.e. the lugs 32 and apertures/sockets 34) also allow multiple strips to be joined together end to end to provide a wrap 10 of added length if desired for any particular application.

A hot water heater 50 incorporating the insulation wrap 10 is illustrated in FIGS. 4 and 5. The hot water heater 50 includes a cylindrical inner tank 52 for holding hot water, a water inlet 51 and a water outlet 53. The inner tank 52 includes a sidewall 54, a top wall 56 and a bottom wall 58. The bottom wall 58 of the tank 52 rests upon a support ring 60 which in turn rests upon a support plate 62.

As also illustrated in FIGS. 4 and 5, the hot water heater 50 includes an outer shell or jacket 64 having a top 66, a cylindrical sidewall 68 and a bottom edge 70. As illustrated, the jacket 64 is coaxial with and radially spaced from the tank 52, thereby forming an annular space or void 72 between the outer surface of the tank 52 and the inner surface of the jacket 64. As further illustrated, the bottom edge 70 of the jacket 64 rests upon the support plate 62.

The support ring 60 and the jacket 64 each include openings 79, 80 that register with each other to provide access to a heating chamber 74 located under the bottom 58 of the tank 52. A gas burner 76 is located within the heating chamber 74. A foam dam 75 is compressed between the sidewall 54 of the tank 52 and the sidewall 68 of the outer jacket 64 as the jacket is positioned over the tank during the assembly process. The void 72 above the foam dam 75 is filled with a polymer foam that is expanded directly in that void or annular space.

The insulation wrap 10 is wrapped around the outer surface of the sidewall 54 of the tank 52 so that the foil layer 20, if present, is butting against the tank 52. In addition, the opening 14 in the strip 12 is aligned with the opening 79 in the support ring 60 that allows access to the heating chamber 74 and the burner 76. As the outer shell or jacket 64 is positioned over the tank 52, an access door 78 in the outer shell or jacket 64 is also aligned with the opening 14. The access door 78 is removed in order to allow access to the gas burner 76 in the heating chamber 74. As illustrated, the fibrous material element 18 outlining the opening 14 fits snugly between the margin of the outer shell or jacket 64 surrounding the access opening 80 therein and the opening 79 in the support ring 60 that provides access to the heating chamber 74. Accordingly, it should be appreciated that the fibrous material element 18 prevents drafts from around the edge of the access door from reaching the gas burner 76 in the heating chamber 74 during water heater operation. Consequently, the only air drawn into the heating chamber 74 to support combustion of the burner flame is from around the bottom of the water heater. This advantageously serves to provide a more consistent burning flame and more efficient heating of water in the tank 52.

The insulation wrap 10 is of a length substantially corresponding to the circumference of the inner tank 52 so that the ends 28, 30 may be joined together and interlocked by either the adhesive backed tape 26 illustrated in FIG. 3*a* or the cooperating projecting lugs 32 and apertures/sockets 34 illustrated in FIG. 3*b* or even a combination of both.

In summary, numerous benefits result from employing the concepts of the present invention. The insulation wrap 10 may be relatively easily secured on the tank 52 of the water heater 50. When properly seated, the strip 12 of nonflammable fibrous material with or without the foil layer 20 effectively insulates the tank in the area adjacent to the heating chamber 74 and gas burner 76. Additionally, the fibrous material element seals around the access door 78 in the outer shell or jacket 64 so as to prevent unwanted air currents that might otherwise adversely affect the burner flame and heating efficiency. Advantageously, this is achieved without in any way compromising access to the burner 76 through the access opening 80 when the access door 78 is moved.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. An insulation wrap for a water heater tank, comprising:

an elongated strip of nonflammable fibrous material formed into a ring which extends completely around a circumference of an inner tank of a water heater, wherein said ring includes a thee substantially following the circumference and an opening in said face; and a fibrous material element contacting said face and outlining at least a portion of said opening.

2. The insulation wrap of claim 1, further including a foil layer on said strop of nonflammable fibrous material.

3. The insulation wrap of claim 1, further including a scrim on said foil layer.

4. The insulation wrap of claim 3, wherein said scrim is fiberglass.

5. The insulation wrap of claim 1, wherein an adhesive secures said fibrous material element to said strip of nonflammable fibrous material.

6. The insulation wrap of claim 1, whet em said strip of nonflammable fibrous material is fiberglass.

7. The insulation wrap of claim 6, wherein said fibrous material element is constructed from a material selected from a group consisting of polyester, polyethylene, polypropylene, polyethylene terephthalate, glass fibers, natural fibers and any mixtures thereof.

8. The insulation wrap of claim 6, wherein said fibrous material element is constructed horn a material selected horn a group consisting of (a) thermoplastic polymer staple fiber's and thermoplastic bicomponent fibers, (b) glass staple fiber's and thermoplastic bicomponent fibers and (c) a combination of (a) and (b).

9. The insulation wrap of claim 1, wherein said fibrous material element is constructed from a material selected horn a group consisting of polyester, polyethylene, polypropylene, polyethylene terephthalate, glass fibers, natural fibers and any mixtures thereof.

10. The insulation wrap of claim 1, wherein said fibrous material element is constructed horn a material selected horn a group consisting of(a) thermoplastic polymer staple fibers and thermoplastic bicomponent fibers, (b) glass staple fibers and thermoplastic bicomponent fibers and (c) a combination of (a) and (b).

11. The insulation wrap of claim 1, wherein said fibrous material element has a density of about 0.75 $lbs/ft^3$.

12. An insulation wrap for a water heater tank, comprising:

an elongated strip of nonflammable fibrous material including a first end, a second end and an opening provided on a face of said strip;

a fibrous material element connected to a margin of said face outlining at least a portion of said opening; and a fastener for securing said first end and said second end together.

13. The insulation wrap of claim 12, wherein said fastener is a tape.

14. An insulation wrap for a water heater tank, comprising:

a ship including a layer of fiberglass laminated to a layer of foil, said strip being formed into a ring which extends completely around the circumference of the inner tank of a water heater wherein said ring includes an opening in a face thereof, wherein said face substantially follows said circumference; and a fibrous material element contacting said face and outlining at least a portion of said opening.

15. The insulation wrap of claim 14, including a fiberglass swim on said layer of foil.

16. The insulation wrap of claim 14, wherein said layer of fiberglass and said layer of foil arc adhered together.

17. The insulation wrap of claim 14, wherein said fibrous material element is constructed from a material selected from a group consisting of polyester, polyethylene, polypropylene, polyethylene terephthalate, glass fibers, natural fibers and any mixtures thereof.

18. The insulation wrap of claim 14, wherein said fibrous material element is constructed from a material selected from a group consisting of (a) thermoplastic polymer staple fibers and thermoplastic bicomponent fibers, (b) glass staple fibers and thermoplastic bicomponent fibers and (c) a combination of (a) and (b).

19. The insulation wrap of claim 14, further including a fastener securing a first end and a second end of said strip together.

20. A water heater, comprising:

an inner tank including a water inlet and a water outlet;

an outer jacket received around said inner tank;

a heating chamber adjacent said inner tank in said outer jacket;

an access door in said outer jacket for accessing said heating chamber; and an insulation wrap, including (a) an elongated strip of nonflammable fibrous material wrapped fully around said inner tank and having an opening provided in a face of said strip aligned with said access door, wherein said face follows a circumference of said inner tank, and (b) a fibrous material element contacting said face and outlining said opening and said access door.

21. The water heater of claim 20, wherein said fibrous material element is constructed from a material selected from a group consisting of polyester, polyethylene, polypropylene, polyethylene terephihalate, glass fibers, natural fibers and any mixtures thereof.

22. The water heater of claim 20, wherein said fibrous material element is constructed from a material selected from a group consisting of (a) thermoplastic polymer staple fibers and thermoplastic bicomponent fibers, (b) glass staple fibers and thermoplastic bicomponent fibers and (c) a combination of (a) and (b).

23. A water heater, comprising:

an inner tank including a water inlet and a water outlet;

an outer jacket received around said inner tank;

a heating chamber adjacent said inner tank in said outer jacket;

an access door in said outer jacket for accessing said heating chamber; and an insulation wrap, including (a) an elongated strip including a layer of fiberglass laminated to a layer of foil wrapped hilly around said inner tank, wherein said layer includes an outer face following the outer jacket, said face include an opening aligned with said access door and (b) a fibrous material element contacting said flee and outlining said opening and said access door.

24. The water heater of claim 23, wherein said fibrous material element is constructed from a material selected from a group consisting of polyester; polyethylene, polypropylene, polyethylene texephthalate, glass fibers, natural fibers and any mixtures thereof.

25. The water heater of claim 23, wherein said fibrous material element is constructed from a material selected from a group consisting of (a) thermoplastic polymer staple fibers and thermoplastic bicomponent fibers, (b) glass staple fibers and thermoplastic bicomponent fibers and (c) a combination of (a) and (b).

26. An insulation wrap, comprising:

a strip of nonflammable fibrous material including a first end, a second end and an opening;

a fibrous material element outlining at least a portion of said opening; and a fastener securing said first end and said second end of said strip of nonflammable fibrous material together, said fastener including cooperating male and female connectors.

27. An insulation wrap for a water tank, comprising:

a ring of nonflammable fibrous material having a face including an opening wherein said ring and said face extend completely around the circumference of the inner tank of a water heater; and a fibrous material element outlining at least a portion of said opening.

28. The insulation wrap of claim 27, wherein said face is an outer face of said ring.

* * * * *

UNITED STATES PATENT AND TRADEMARK OFFICE

CERTIFICATE OF CORRECTION

PATENT NO. : 7,380,524 B2
APPLICATION NO. : 10/609929
DATED : June 3, 2008
INVENTOR(S) : Hand It is certified that error appears in the above-identified patent and that said Letters Patent is hereby corrected as shown below:

Claims:

Col. 5, lines 49-55 should read,

1) An insulation wrap for a water heater tank comprising: an elongated strip of nonflammable fibrous material formed into a ring which extends completely around a circumference of an inner tank of a water heater, wherein said ring includes a face substantially . . .

lines 56-57 should read,

2) The insulation wrap of claim 1, further including a foil layer on said strip of . . .

lines 66-67 should read,

6) The insulation wrap of claim 1, wherein said . . .

Col. 6, lines 6-11 should read,

8) The insulation wrap of claim 6, wherein said fibrous material element is constructed from a material selected from a . . .

Col. 6, lines 12-15 should read,

9) The insulation wrap of claim 1, wherein said fibrous material element is constructed from a material selected from a . . .

Col. 6, lines 16-20 should read,

10) The insulation wrap of claim 1, wherein said fibrous material element is constructed from a material selected from a . . .

Col. 6, lines 36-42 should read,

14) An insulation wrap for a water heater tank, comprising: a strip including . . .

Col. 6, lines 47-48 should read,

15) The insulation wrap of claim 14, including a fiberglass scrim on . . .

Col. 6, lines 49-50 should read,

16) The insulation wrap of claim 14, wherein said layer of fiberglass and said layer of foil are adhered . . .

Col. 7, lines 12-16 should read,

21) The water heater of claim 20, wherein said fibrous material element is constructed from a material selected from a group consisting of polyester, polyethylene, polypropylene, polyethylene terephthalate, glass . . .

Signed and Sealed this
Sixth Day of March, 2012

David J. Kappos

David J. Kappos
*Director of the United States Patent and Trademark Office*

Col. 7, lines 23-34 and Col. 7, lines 1-2 should read,

23) A water heater, comprising: an inner tank including a water inlet and a water outlet; an outer jacket received around said inner tank; a heating chamber adjacent said inner tank in said outer jacket; an access door in said outer jacket for accessing said heating chamber; and an insulation wrap, including (a) an elongated strip including a layer of fiberglass laminated to a layer of foil wrapped fully around said inner tank, wherein said layer includes an outer face following the outer jacket, said face include an opening aligned with said access door and (b) a fibrous material element contacting said face and . . .

Col. 8, lines 3-7 should read,

24) The water heater of claim 23, wherein said fibrous material element is constructed from a material selected from a group consisting of polyester; polyethylene, polypropylene, polyethylene terephthalate, glass . . .